US005397875A

United States Patent [19]

Bechtold, Jr.

[11] Patent Number: 5,397,875

[45] Date of Patent: Mar. 14, 1995

[54] PORTABLE APPLIANCE FOR HEATING TOWELS AND FOR DISPENSING HEATED FLUID SUCH AS BODY OIL TO FACILITATE THE ADMINISTRATION OF A MASSAGE

[76] Inventor: Joseph A. Bechtold, Jr., 3890 Salisbury Rd., South Euclid, Ohio 44121

[21] Appl. No.: 981,067

[22] Filed: Nov. 24, 1992

[51] Int. Cl.[6] ..... H05B 3/00; B65D 69/00

[52] U.S. Cl. ..... 219/521; 219/386; 219/432; 219/524; 219/525; 206/581; 206/438; 132/315; 68/276

[58] Field of Search ..... 219/521, 386, 387, 401, 219/432, 524, 525; 206/581, 570, 438, 389, 494, 449, 205, 229, 569; 132/315, 294, 295, 286; 68/276, 15, 22 A

[56] References Cited

U.S. PATENT DOCUMENTS

| | | | |
|---|---|---|---|
| 1,418,142 | 5/1922 | Fenaes et al. | 222/146.5 |
| 1,464,255 | 8/1923 | Zimmerman | 219/432 |
| 1,715,913 | 6/1929 | Halk | 206/581 |
| 1,804,752 | 5/1931 | Dooley | 68/5 |
| 1,979,222 | 10/1934 | Goodwin | 219/386 |
| 2,209,430 | 7/1940 | Turshin | 222/146.5 |
| 2,215,688 | 9/1940 | Chamberlain | 219/38 |
| 2,228,934 | 1/1941 | Tjomsland | 128/36 |
| 2,230,238 | 2/1941 | Duberstein et al. | 206/581 |
| 2,324,337 | 7/1943 | Tjomsland | 222/146.5 |
| 2,340,932 | 2/1944 | Chalupa | 219/214 |
| 2,352,951 | 7/1944 | Geria | 222/146.2 |
| 2,443,321 | 6/1948 | Miner, Jr. | 219/401 |
| 2,825,208 | 3/1958 | Anderson | 206/581 |
| 3,074,394 | 1/1963 | Witt | 219/387 |
| 3,190,502 | 6/1965 | Knibb | 222/146 |
| 3,307,687 | 3/1967 | Steinman | 206/229 |
| 3,591,768 | 7/1971 | Torres | 219/387 |
| 3,678,248 | 7/1972 | Tricault et al. | 219/525 |
| 3,732,955 | 5/1973 | Carter et al. | 206/223 |
| 3,746,837 | 7/1973 | Frey et al. | 219/387 |
| 3,814,900 | 6/1974 | Frey et al. | 219/385 |
| 3,869,595 | 3/1975 | Collins et al. | 219/387 |
| 3,902,044 | 8/1975 | Doyle et al. | 219/284 |
| 3,974,358 | 8/1976 | Goltsos | 219/387 |
| 3,978,238 | 8/1976 | Frey et al. | 426/523 |
| 4,084,080 | 4/1978 | McMahan | 219/401 |
| 4,163,896 | 8/1979 | McAvinn et al. | 219/386 |
| 4,350,274 | 9/1982 | Morgan | 206/223 |
| 4,419,568 | 12/1983 | Van Overloop | 219/441 |
| 4,523,078 | 6/1985 | Lehmann | 219/386 |
| 4,836,368 | 6/1989 | Cotton | 206/205 |
| 4,857,708 | 8/1989 | DeMars | 219/521 |
| 4,918,290 | 4/1990 | DeMars | 219/386 |
| 4,947,026 | 8/1990 | Groom et al. | 219/401 |
| 5,183,994 | 2/1993 | Bowles, Sr. et al. | 219/387 |
| 5,208,896 | 5/1993 | Katayev | 219/432 |
| 5,296,681 | 3/1994 | Tschauder | 219/401 |

*Primary Examiner*—Bruce A. Reynolds
*Assistant Examiner*—John A. Jeffery
*Attorney, Agent, or Firm*—David A. Burge

[57] ABSTRACT

A portable appliance for heating towels and for dispensing heated fluid such as body oil has a suitcase-like housing with hinge-connected base and lid components that define a plurality of compartments for heating towels and liquid when the housing is "open" and the appliance is "set up" for operation, and for receiving components of the appliance so that the appliance can be conveniently stored and transported when the housing is "closed." When the housing is open, a support structure such as a set of legs is removable from the housing for use in supporting at least a base portion of the housing at an a convenient access height above a floor or other substantially horizontal surface. A relatively large main compartment is defined by the housing for receiving and suitably heating towels therein for use in concert with the administration of a massage. "Wet" or "dry" towel heating can be carried out within the main heating compartment. A "wringer" preferably is provided to extract excess moisture from heated towels.

38 Claims, 6 Drawing Sheets

PORTABLE APPLIANCE FOR HEATING TOWELS AND FOR DISPENSING HEATED FLUID SUCH AS BODY OIL TO FACILITATE THE ADMINISTRATION OF A MASSAGE

BACKGROUND OF THE INVENTION

1. Field of the Invention

The present invention relates generally to a portable appliance for heating towels and fluid such as body oil that commonly are used in concert with the administration of a massage. More particularly, the present invention relates to a portable electrical heating appliance that preferably utilizes a suitcase-like protective housing to facilitate transport and storage of the appliance, with the housing defining a relatively large main compartment for heating towels, and at least one relatively smaller auxiliary compartment within which the fluid contents of a dispensing container can be heated.

2. Prior Art

It is known to use heated towels together with heated fluid such as body oil in concert with the administration of a massage. However, proposals for apparatus to heat towels typically do not provide a means to heat fluids; and, proposals to heat fluids typically do not provide a means to heat towels.

To heat towels, a variety of electrically operated devices have been proposed, few of which are intended to be transported and stored with the convenience of a suitcase. Some of these proposals are intended for use in "dry" heating towels. Some are intended for "wet" heating towels. Some are said to be adaptable to effect either "dry" or "wet" heating. Most of these proposals relate to relatively complex units that are intended for salon or barber shop use, not for consumer use in a typical home environment.

To heat fluids, some heating devices have been proposed for insertion into fluid that is carried in a container such as a coffee cup or mug; and, some heating devices have been proposed that are intended to receive and warm containers of fluid, typically baby-feeding bottles. However, few of these proposals relate to portable units that are transportable with the ease of a suitcase, or that are intended not only to heat but also to transport and store dispenser-type containers of fluid. While some portable appliances have been proposed for heating and/or maintaining the elevated temperature of such consumable beverages as coffee, tea or hot chocolate, the devices that embody these proposals typically are found not to be well suited for use with dispenser-type containers of fluid such as body oil that are used in concert with the administration of a massage.

While the benefits of massage in relieving muscle aches and pains, and in relieving "tension," "stress" and the like are well known, a need long has existed for an easy-to-transport, easy-to-store, highly versatile kit-like unit that can be used at a bedside or elsewhere in the home to assist in providing properly heated towels, properly heated body oil and the like to facilitate the administration of a massage.

SUMMARY OF THE INVENTION

The present invention addresses the foregoing and other needs and drawbacks and of the prior art by providing a novel and improved portable appliance for heating towels and fluids such as body oil that commonly are used in concert with the administration of a massage.

One feature of the preferred practice of the present invention resides in its provision of a suitcase-like housing having hinge-connected base and lid components that are utilized to define a plurality of appropriately configured compartments 1) to permit a supply of spare towels to be kept readily at hand while other towels are being heated selectively in a "dry" or "wet" manner; 2) to permit a dispensing container of fluid such as body oil to also be heated to and maintained at a desired temperature at the same time that towels are being heated; and, 3) to cooperatively receive and enclose not only the various component parts of the unit but also a supply of towels and dispensable fluid such as body oil when the unit is not being used, whereby not only the appliance but also such supplies as typically are used with the appliance can be stored and transported from place to place as a "kit," but with the ease and convenience of a suitcase.

Other features of the preferred practice of the invention cooperate synergistically to provide an appliance that, when "set up" (i.e., when assembled and readied to function), provides a well-balanced, height-adjustable unit that can be positioned almost anywhere that it is needed to facilitate the administration of a massage. Preferably included in this combination are such features as: 1) lid and base components of a hinged, suitcase-like housing that utilize slide-together hinge components which permit the lid to be easily disconnected from the base so that the base can be stand-supported without being rendered unduly top-heavy or being thrown out-of-balance by the weight of the lid; 2) electrical components and associated circuitry that, with the exception of a power cord that is extensible from within a compartment of the base, are confined to and housed within the base whereby the base of the unit provides all of the electrical heating functions of the unit; and, 3) the provision of an elongate compartment within the lid, from which support means such as an adjustable set of legs can be removed and connected to the base for supporting the base at desired heights above a support surface such as a floor. The advantageous arrangement that results from the aforedescribed combination of features permits the lid of the appliance to be set aside while the appliance is being used, whereby the appliance can be positioned, for example, at a bedside so that properly heated towels and properly heated body oil readily are made available to facilitate the administration of a massage for purposes of warming and relaxing aching back muscles of a person who is resting on the bed.

To summarize, in accordance with the preferred practice of the present invention, a portable appliance is provided for heating towels and for dispensing heated fluid such as body oil. The appliance preferably has a suitcase-like housing with hinge-connected base and lid components that define a plurality of compartments. The compartments that are defined by the housing serve 1) to heat towels and fluid when the appliance is "set up" for operation, and 2) to receive components of the appliance so that the housing of the appliance can be closed with such components and a set of supplies being housed therein—to enable the resulting "kit" to be conveniently stored and transported. When the housing is open, a support structure such as a set of legs is removable from the housing for use in supporting at least the base portion of the housing at an a convenient access height above a floor or other substantially horizontal surface. A relatively large main compartment is defined by the housing for receiving and suitably heating towels therein for use in concert with the administration of a massage. "Wet" or "dry" towel heating can be carried out within the main heating compartment.

An optional "wringer" may be provided to assist in extracting excess moisture from heated towels. In preferred practice, the wringer is a unit within which towels can be "wet" heated, whereafter a clamp-like handle of the wringer is operated to compress the heated towels to extract excess moisture.

A fuse-protected electrical cord preferably is permanently connected to the housing and is extensible from a housing-defined compartment when the housing is open to provide power for operating one or more housing-carried heaters to heat the main compartment and at least one dispensable liquid container that is removably carried within a suitable housing-defined compartment. To avoid having a non-fuse-protected electrical cord substituted for the fuse-protected cord, it is preferred that the power cord be permanently connected to the base.

If desired, instead of utilizing a base-carried heater to heat both a fluid container and its contents, a fluid container that incorporates its own heating element may be employed, with plug-in-contact being made with the base when the container is positioned to engage an electrical connector provided in a base-defined compartment.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
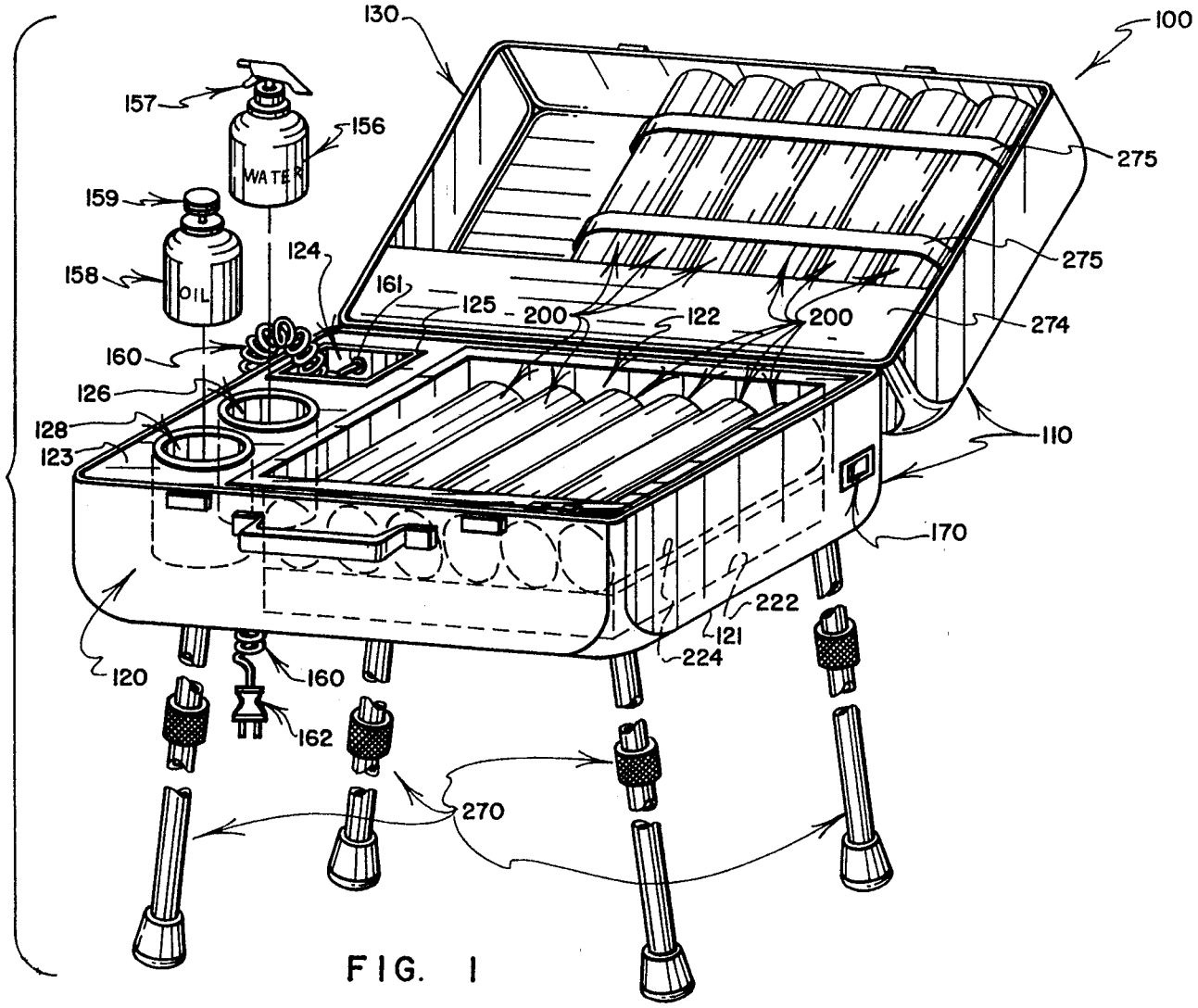
FIG. 1 is a exploded perspective view of a portable appliance that embodies the preferred practice of the present invention, with the suitcase-like housing of the appliance shown in an open position, with foreshortened leg-like supports shown removed from their storage position and connected to the base of the housing to support the housing in an elevated position, with an electrical power cord shown extending from its storage compartment to a position outside the housing, with rolled towels shown both in the lid and base of the housing, and with a pair of liquid containers that normally are carried in compartments in the base shown elevated above the base.
Figure 2:
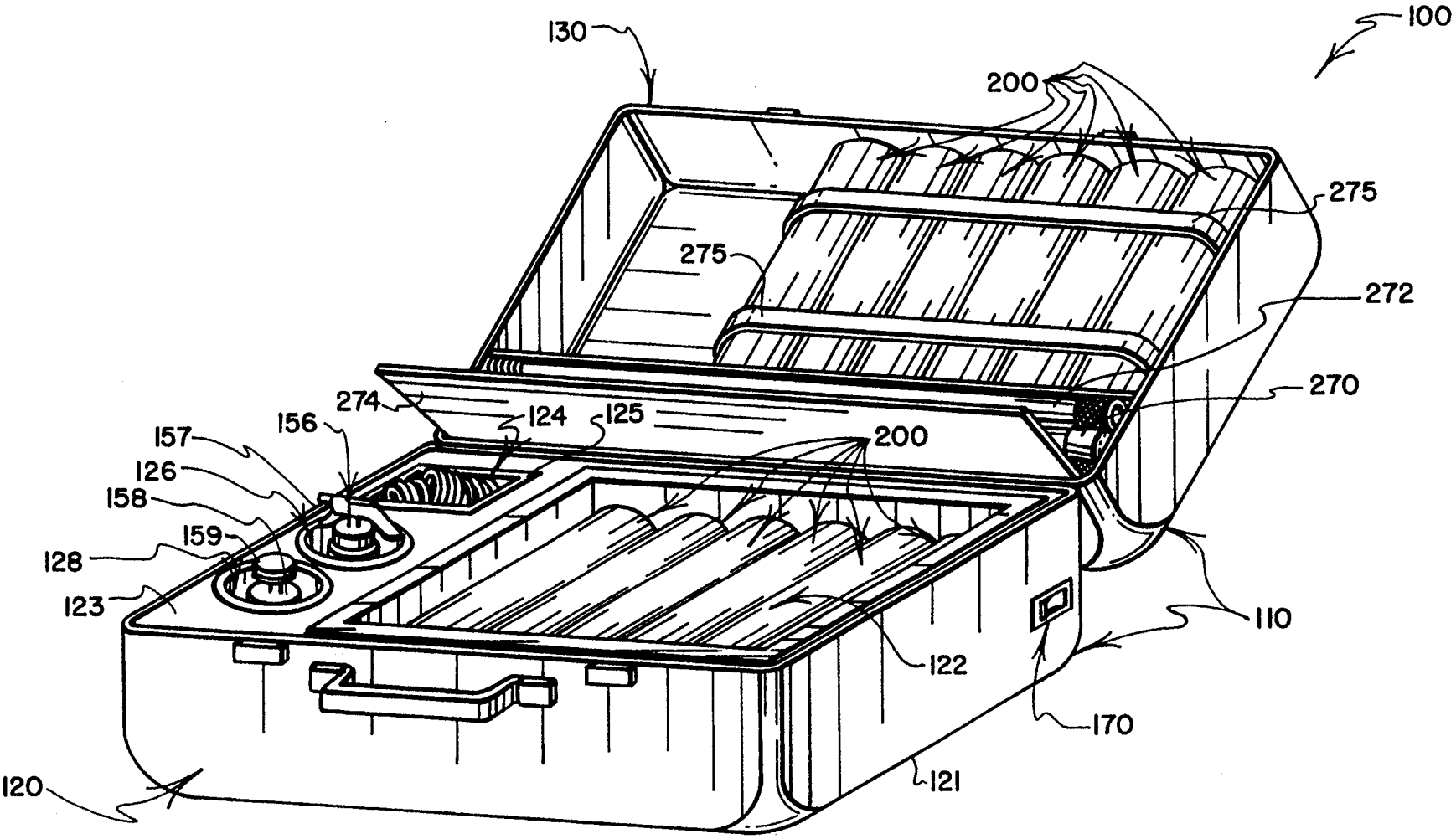
FIG. 2 is a perspective view of the appliance of FIG. 1, but with the leg-like supports stored in a compartment that is provided in the lid of the housing, with the power cord retracted to a position within a compartment that is provided for it in the base, and with the pair of liquid containers positioned in the compartments that they normally occupy within the base.

Referring to FIGS. 1 and 2, a portable electric appliance for heating towels and for dispensing heated fluid such as body oil to facilitate the administration of a massage is indicated generally by the numeral 100. While the appliance 100, in the form depicted in the drawings and described herein, represents the "best mode" and the "preferred manner of carrying out the practice of the present invention" known to the inventor at the time of filing, it will be understood by those who are skilled in the art that modifications may be made, substitutions may be incorporated, and improvements may be provided that are, nonetheless, well within the spirit and scope of the invention that is described in the specification and addressed by the appended claims hereof.

Referring still to FIGS. 1 and 2, the portable appliance 100 has an outer protective casing or housing that is indicated generally by the numeral 110. The casing or housing 110 includes a base 120 and a cover or lid 130 that are releasably, pivotally hinge-connected.

Figure 3:
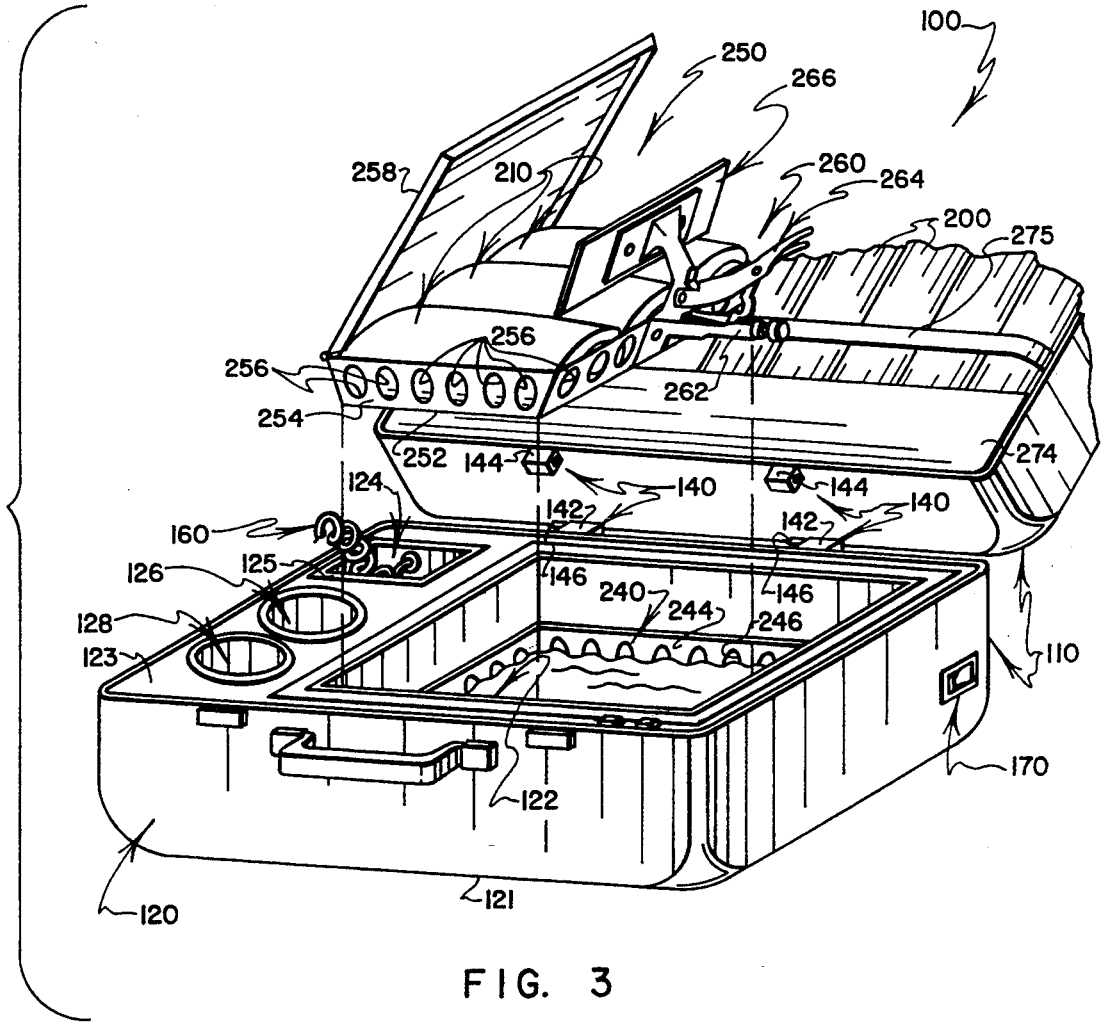
FIG. 3 is a perspective view of the appliance showing principally base portions thereof, but with the view also showing a disconnected portion of the lid of the housing, slide-together hinge components for releasably pivotally connecting the lid to the base of the housing, and an optional "wringer" device that can be inserted into the main heating compartment of the base of the appliance.

While hinge components that are carried by the base 120 and by the lid 130 are not shown in FIGS. 1 and 2, referring to FIG. 3, two sets of disconnected hinge components are indicated generally by the numeral 140. Each of the hinge sets 140 includes a base-carried hinge component 142 of generally "male" configuration, and a lid-carried hinge component 144 of generally "female" configuration. The hinge components 142, 144 of each of the sets 140 can be slided together to selectively connect the base 120 with the lid 130 for pivotal movement about a common axis (not shown) along which pin portions 146 of the base-carried components extend, or can be slided along the common axis (not shown) of the pin portions 146 to selectively disconnect the base 120.from the lid 130 so that the lid 130 can be separated from the base 120, as is depicted in FIG. 3.

Referring still to FIGS. 1 and 2, defined within the base 120 is a relatively large, generally rectangular, pan-like compartment 122 that will be referred to as defining the "main heating compartment." Located to one side of the main heating compartment 122 is a power cord storage compartment 124, and a pair of compartments 126, 128 that are provided for receiving a pair of liquid dispensing containers 156, 158. In FIG. 1, the liquid dispensing containers 156, 158 are shown raised out of the compartments 126, 128. In FIG. 2, the liquid dispensing containers 156, 158 are shown nested within their associated compartments 126, 128.

In FIG. 1, portions of a coiled power cord 160 are shown extending out of the power cord storage compartment 124 and depending along and beneath left side portions of the base 120. A fuse-carrying two-prong electrical plug 162 is shown at one end of the power cord 160. To prevent a non-fuse-carrying power cord to be substituted for the fuse-carrying power cord 160, it will be understood by those who are skilled in the art that the other end region of the power cord 160 is permanently connected to the base 120, preferably using a commercially available water-tight grommet assembly 161 located within the power cord storage compartment 124 at a position that is relatively near a rim 125 of the power cord storage compartment 124.

To prevent moisture or the like from entering into the interior of the base 120 (i.e., into the space that extends between an outer cover 121 of the base 120 and an interior cover sheet 123 through which the various compartments 122, 124, 126, 128 open, or between the outer cover 121 and such structure as defines the compartments 122, 124, 126, 128), suitable moisture seals (not shown) are provided in a manner that is well known to those who are skilled in the art. Also, to prevent moisture or the like from entering into the interior of the base 120, each of the compartments 122, 124, 126, 128 is formed as a "sealed unit" that has a capability for receiving and retaining liquid without leakage. Thus, for example, if liquid is spilled inadvertently onto the cover sheet 123, the spilled liquid will not find its way into the interior of the base 120 where, as will be explained shortly, electrical heating components and associated circuitry are provided that electrically connect with the power cord 160.

Located along the right side of the outer cover 121 of the base 120 (as is depicted in FIGS. 1–3), is a manually operated power switch 170 that must be turned to an "on" position (not shown) to permit electrical power from the power cord 160 to be delivered to electrical heater components and other associated circuitry that are housed within the aforedescribed sealed interior of the base 120. By turning the power switch 170 to an "off" position (not shown), the delivery of electricity to electrical heater components and other associated circuitry that are housed within the interior of the base 120 is terminated.

While the power switch 170 is depicted as being located along the right side of the base 120, those who are skilled in the art will understand that the switch 170 may be positioned elsewhere on the base 120 so as to provide a conveniently located "off/on" switch. In preferred practice, the switch 170 is positioned at a location where the switch 170 is least likely to be splashed by water or other fluid as heated towels and heated fluid are provided in concert with the administration of a massage. However, to maximize safety, a water and weather resistant style of switch is selected to comprise the switch 170, many forms of which are commercially available.

Figure 6:
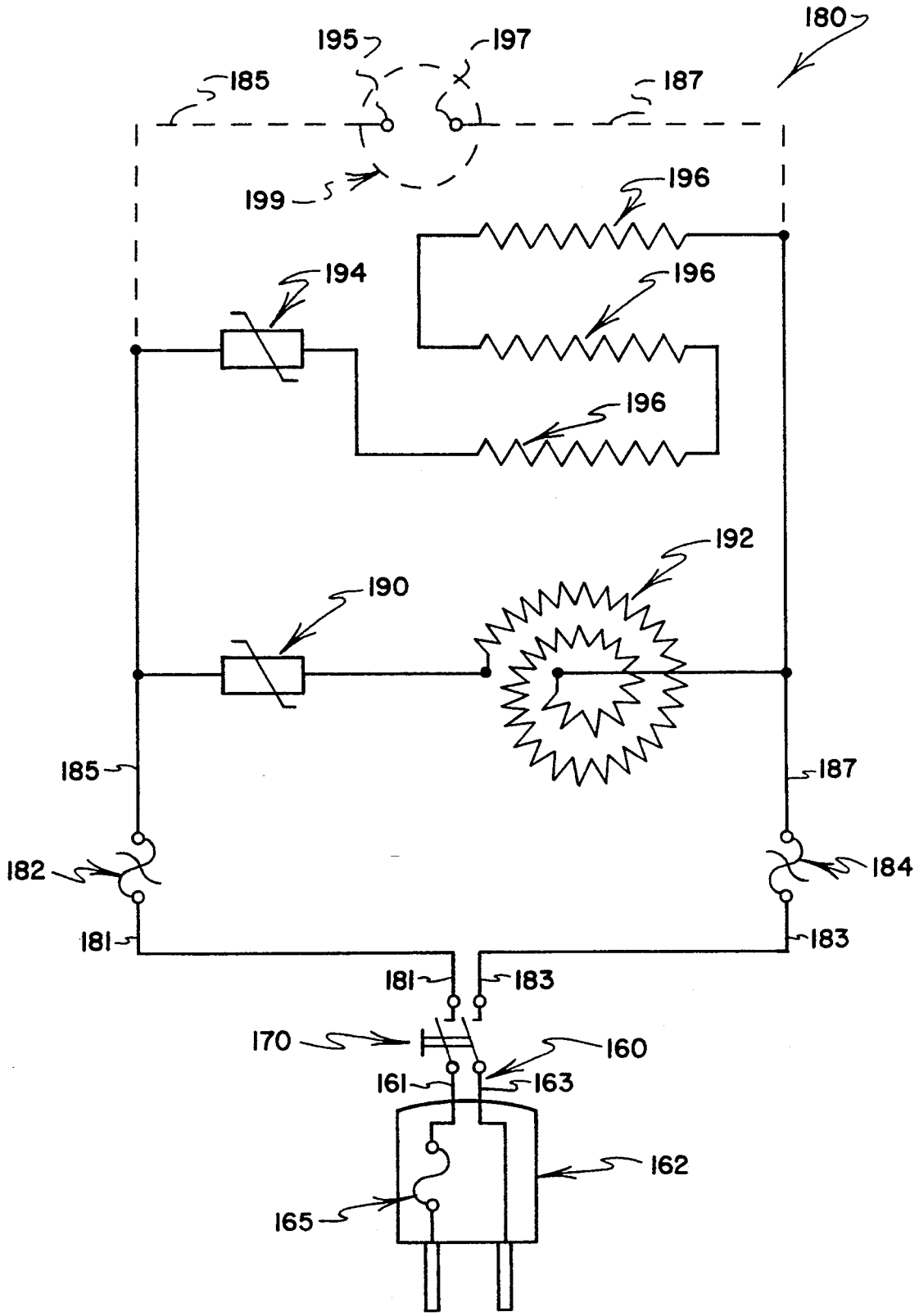
FIG. 6 is a schematic diagram illustrating a typical electrical control circuit of the type that can be used to operate electrical components of the appliance, with dotted lines schematically indicating a simple manner in which the circuit that is shown in solid lines can be optionally extended to include a female electrical connector.

Referring to FIG. 6, a schematic diagram is provided to illustrate the character of such electrical circuit components as typically are utilized by the appliance 100 as component parts of a circuit that is designated generally by the numeral 180. Beginning toward the bottom of FIG. 6, the power cord 160 is depicted as having two electrical conductors 161, 163 that connect with the fuse-carrying two-prong plug 162. Housed within the plug in a replaceable manner is a fuse 165 that is selected to "blow" if current flowing into the circuit 180 exceeds that which is found during tests to comprise the normal maximum level of current that is required by the appliance 100 for proper operation.

Continuing with a description of the components of the electrical circuit 180 that is depicted in FIG. 6, the "off/on" power switch 170 serves to selectively connect the conductor 161 with a conductor 181; and to simultaneously selectively connect the conductor 163 with a conductor 183. Thermal sensor/protector devices 182, 184 are interposed between the conductor 181 and a conductor 185; and between the conductor 183 and a conductor 187. The thermal sensor/protector devices 182, 184 may take any of a wide variety of commercially available forms that serve to electrically connect two conductors when no condition of "overheat" is sensed, and that serve to disconnect such conductors when a condition of "overheat" is sensed. The thermal sensor/protector devices 182, 184 are positioned as desired within the interior of the base 120 to sense and respond to overheating of such structures as form the main heating compartment 122 and the auxiliary compartment 128 wherein the container 158 preferably also is heated by components of the circuit 180. Upon sensing a condition of "overheat," either of the thermal sensor/protector devices 182, 184 can cut off the flow of power to the appliance 100 by terminating the electrically connection that normally is provided between its associated conductors 181, 185 and/or 183, 187, respectively.

The conductors 185, 187 are utilized to provide electrical power to one or more thermostatically controlled heating devices. By way of one example, a commercially available thermostat control switch 190 is connected in series with a circularly disposed, resistance-type electrical heating element 192 that preferably is positioned to extend beneath and about the side walls of the auxiliary heating compartment 128 within which a container 158 of body oil or the like normally is positioned so as to be heated at the same time that towels are being heated within the main heating chamber 122. The thermostat 190 is selected to maintain an appropriate heating temperature for warming the container 158 and its contents so that body oil or other contents of the container 158 can be provided at an appropriately heated temperature.

If desired, a thermostat and coiled resistance-type electrical heating element (not shown) that are similar to the thermostat 190 and the heating element 192 also may be provided to heat the container 156 that is carried within the compartment 126; however, inasmuch as a supply of water typically is provided by the container 156, and inasmuch as the water supplied by the container 156 is not always desired to be of "heated" character, the circuit 180 often does not include a thermostat or a separate heating element for serving the compartment 126.

To heat the main heating chamber 122, a commercially available thermostat control switch 194 is connected in series with a series array of resistance-type electrical heating elements 196 that preferably are positioned to extend beneath and about the side walls of the main heating chamber 122. The thermostat 194 is selected to maintain an appropriate heating temperature for warming the structure of the chamber 122 so that towels that are positioned within the main heating chamber 122 may be suitably "wet" or "dry" heated. The series arrangement of the thermostat 194 and the heating elements 196 preferably is connected in parallel with the series arrangement of the thermostat 190 and the heating element 192 between the electrical conductors 185, 187 to receive electrical power therefrom.

Figure 7:
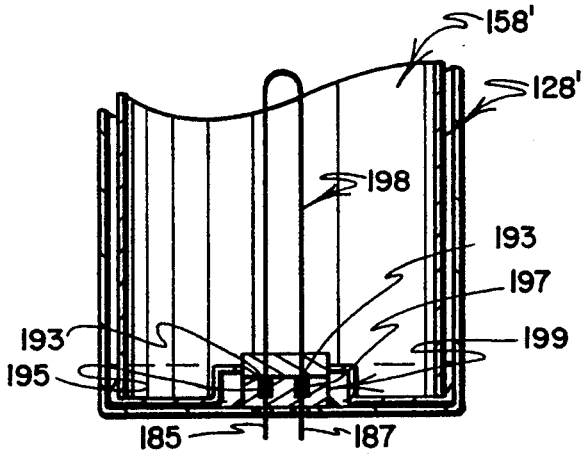
FIG. 7 is a sectional view showing bottom portions of an optional form heater-carrying liquid container and of a base compartment portion that receives the bottom portions of the container, with the container carrying a depending male electrical connector that is engaged with a female electrical connector that is carried by the bottom portions of the container so as to establish electrical connection between the engaged male and female connectors; and, FIG. 8 is an exploded perspective view on an enlarged scale of the optional container and base portions of FIG. 7, with portions broken away to permit otherwise hidden features and detail to be seen, and with the female and male electrical connectors disengaged.
Figure 8:
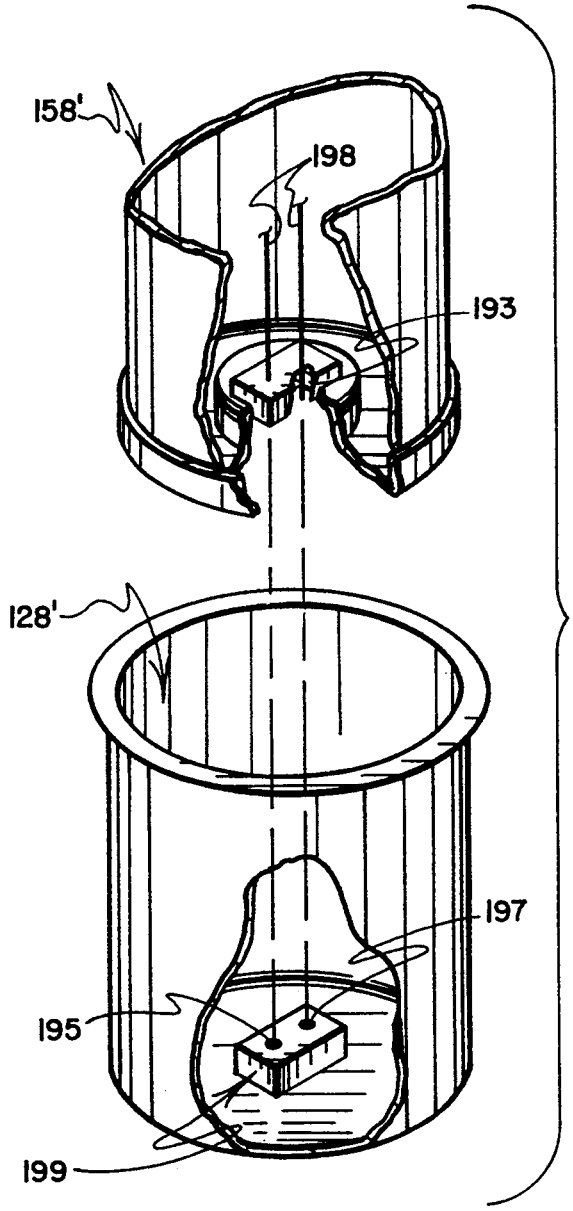

Shown in dotted lines toward the top of FIG. 6 are extensions of the conductors 185, 187 that connect with corresponding female connector contacts 195, 197, respectively, of an electrical plug 199. Referring to FIGS. 7 and 8, the use of the electrical plug 199 and mating-connector-carrying container that houses its own heating element 198 represent a less preferred manner in which an alternate form of fluid container such as the body oil container 158' can be heated while being positioned within an alternate form of the compartment 128'.

Actually, the structure of the compartment 128' is identical to that of the compartment 128 except that the compartment 127' has the connector 199 rigidly connected to an interior surface portion of its bottom wall. The plug 199 carries the female contacts 195, 197 that mate with the male contacts 193 of the heating element 198 when the container 158' is properly seated within the compartment 128'. In essence, the in-container heater element 198 resembles that which is used in many known types of coffee containers that "plug in" when positioned in engagement with a power-supplying appliance (not shown).

One reason why one might elect the described "alternate approach" is that the direct heating of a body of contained liquid (as by energizing a heating element 198 that extends directly into the body of liquid) often requires substantially less energy to effect the same result as is needed to indirectly heat the contained body of liquid by first heating its surrounding container.

Another reason why one might elect to use the aforedescribed alternate approach is that it can be used in concert with use of the resistance heater element 192 so that rapid heating of the body of fluid within the container 158' can be effected both by applying heat energy directly to the liquid by means of the container-carried heating element 198, and also by heating exterior surface portions of the container 158' by using the heating element 192. In preferred practice, however, only a single type of heating approach is utilized to warm liquid that is contained within a container 158 or 158'.

While the discussion that is provided herein tends to concentrate on the use of electrical resistance heating elements as a source for providing heat energy for heating towels and fluid such as body oil or the like, those who are skilled in the art readily will understand that other known and future forms of sources of heat energy (typically having their origin with a supply of electrical current, although other efficient and appropriately safe origins of heat energy are known and undoubtedly will be more commonly used with portable appliances during years to come) may be substituted and used herein without extending beyond the spirit and scope of the accompanying claims.

The liquid containers 156, 158, 158' preferably are provided with top openings (not shown) through which liquid to be dispensed is inserted into the interiors of the containers 156, 158, 158' and into which any desired form of commercially available cap-carried liquid dispenser (such as the cap-carried dispensers 157, 159 shown in FIGS. 1 and 2) are inserted to enable liquid to be easily manually dispensed from the containers 156, 158, 158'.

The main heating compartment 122 has lower and upper portions that are depicted by in phantom in FIG. 1 by a pair of rectangular box-like forms, with the lower portion being designated generally by the numeral 222, and with the upper portion being designated generally by the numeral 224. In the so-called "dry" heating of towels, a side-by-side array of relatively tightly rolled towels 200 preferably are supported to extend through the upper portion 224 of the main heating compartment 122 (in the manner that is depicted in FIGS. 1 and 2) so that the relatively tightly rolled towels 200 can be warmed by rising moist air and steam from the lower portion 222 of the main heating compartment 122. In the so-called "wet" heating of towels, a small number of relatively loosely rolled towels 210 preferably are positioned side-by-side within an optional "wringer" device 250 that is shown in FIGS. 3–5.

Figure 4:
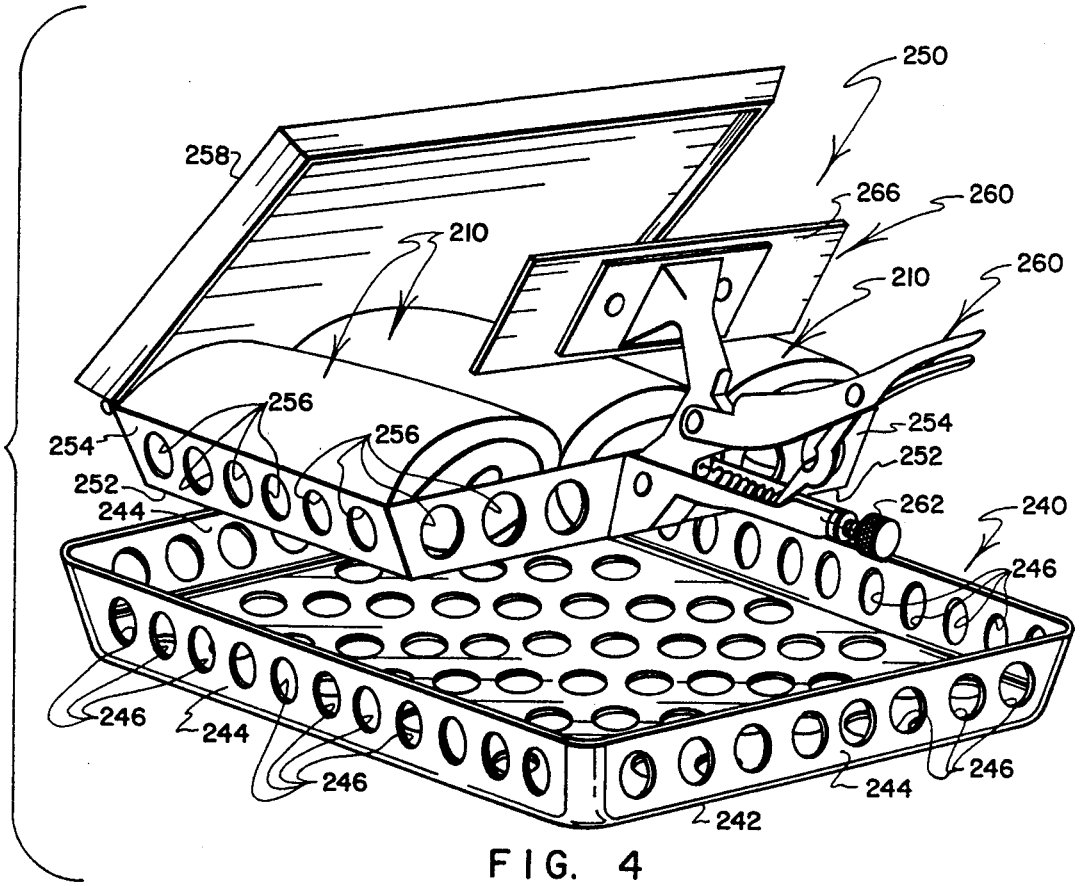
FIG. 4 is a perspective view of the wringer device of FIG. 3 but on an enlarged scale.
Figure 5:
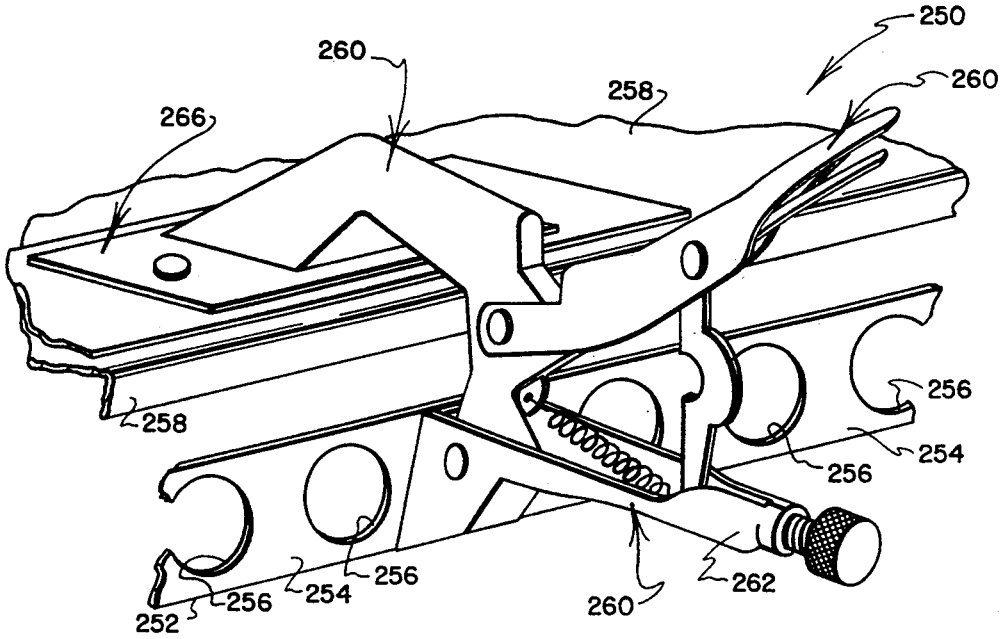
FIG. 5 is a perspective view of lid clamping portions of the wringer device, with portions of the lid and tray of the wringer also being shown, and with the view being on an enlarged scale.

Referring to FIG. 4, a pan-like support device 240 is shown that preferably is used both "dry" and "wet" heating of towels. The pan-like device 240 has a bottom wall 242 and an upstanding side wall 244 that joins with and perimetrically surrounds the bottom wall 242. Holes 246 are formed through the bottom and side walls 242, 244. The pan-like device is sized to let is easily slip fit into the lower portion 222 of the main heating compartment 122, and its size is sufficient to permit the wringer device 250 to be easily lowered into a nested position therein, and to be easily raised outwardly therefrom.

A function that the pan-like device 240 serves during "wet" heating of towels is to provide something of a "liner" in the bottom or lower portion 222 of the main heating compartment 122 to help prevent the walls of the main heating compartment 122 from being scratched or scuffed as the wringer device 250 is repeatedly inserted into and removed from the main heating compartment 122 to sequentially heat (and occasionally to reheat) small numbers of towels 210. To carry out this function, the pan-like device 240 is positioned in the bottom portion 222 of the main heating compartment 122 (as is depicted in FIG. 5) in a "right-side-up" orientation (i.e., with the bottom wall 242 extending along the bottom wall of the main heating compartment 122).

A function that the pan-like device 240 serves during "dry" heating of towels is to provide a pervious support for positioning relatively tightly rolled towels 200 within the upper portion 224 of the main heating compartment 122. To carry out this function, the pan-like device 240 is inverted (i.e., turned "upside down") relative to the "right-side-up" orientation that is depicted in FIG. 4. By this arrangement, when the pan-like device 240 is inserted into the bottom portion 222 of the main heating chamber 122, the bottom wall 242 is spaced upwardly from the bottom wall of the compartment 122 to support the towels 200 at a height that will facilitate an upward flow of moist air and steam from such water as is being heated in the bottom of the compartment 122. The rising moist heated air and steam tends to penetrate and warm the towels 200 so that, within a reasonably short period of time, the towels 200 are properly heated and are continuing to be heated to a proper temperature for use in concert with the administration of a massage.

A feature of "dry" heating is that, once the appliance 100 is "set up" and loaded with rolled towels 200 that are being heated in the manner just described, a relatively large number of towels 200 is made available that will permit withdrawal from the appliance 100 and return to the appliance 100 of a significant "recycle rate" of "dry" heated towels that will facilitate the administration of a massage. While the capacity of the appliance 100 to provide "dry" heated towels in a steady and substantially uninterrupted, relatively high "recycle rate" is unusual, this "heavy duty" capacity is appropriate, for it is precisely the circumstance of administering a massage wherein "dry" heated towels are being used that such a capacity often is most dearly needed. Thus, in meeting the often "high capacity" need for supplying "dry" heated towels, the apparatus 100 scores highly.

Because circumstances are encountered from time to time wherein the "deep-heat" penetration capability of "wet" heated towels is needed, the apparatus 100 also is designed to respond quite nicely to the nature of this need. "Wet" heated towels typically take a bit longer to heat than do "dry" heated towels—but, when properly heated, tend to retain heat for a longer period of time, whereby the towels tend to be left in place for longer periods of time, and fewer tend to be required during a given period of time than usually is the case with the use of "dry" heated towels.

To accommodate this very different character of need for the supply of "wet" heated towels, and to provide "wet" heated towels at a relatively slow but entirely appropriate pace as they are needed in concert with the administration of a massage, towels 210 that are to be "wet" heated are rolled into relatively loose coils, and, as is depicted in FIG. 4, only a few at a time (typically about three) are introduced into the wringer device 250 for insertion into such hot water as is being substantially continuously heated at the bottom of the main heating compartment 122. Because "wet" heated towels tend to be used and returned for reheat at a much slower pace than are "dry" heated towels, the "small batch at a time" approach that is employed in accordance with the preferred practice of the present invention is found to coincide quite nicely with the actual need that typically is encountered in conjunction with the administration of a massage wherein "wet" heated towels are being used.

Referring to FIGS. 3 and 4, the wringer device 250 has a bottom wall 252, an upstanding perimetrically-extending side wall 254, and holes 256 formed through the bottom and side walls 252, 254. A lid 258 is pivotally hinge-connected to the side wall 254. While holes (not shown) could be provided in the lid 258 to permit the passage therethrough of moist heated air and steam, it is believed that the dual objectives of providing a strong, non-deforming lid 258, and of capturing heat energy from rising flows of moist heated air and steam are better served by providing few if any holes through the lid 258. When the lid 258 is firmly clamped into engagement with the upper edge region of the perimetrically-extending side wall 254, such relatively loosely rolled towels 210 as are carried within the wringer device 250 are caused to be compressed so as to "squeeze out" excess moisture.

Referring to FIG. 3 and 4, a handle-operated clamp 260 is connected to the upstanding side wall 254. The handle-operated clamp 260 serves a number of purposes, one of which is simply to provide a graspable handle that will facilitate one's moving the wringer device 250 into and out of the pan-like member 240 when the pan-like member 240 is positioned within the bottom region 222 of the main heating chamber 122. A main lever assembly 262 is rigidly connected to the side wall 254 for purposes of providing such a graspable handle. An operating lever assembly 264 is linkage-connected to the main lever assembly 262, and connects with a clamping member 266 that is "released from claiming" when the handles assemblies 262, 264 are positioned as shown in FIGS. 3 and 4 so as to neither block nor hinder pivotal movements of the lid 258 between "open" and "closed" positions.

When the lid 258 is closed and the handle assemblies 262, 264 are moved relative to each other to the positions that are depicted in FIG. 5, the clamping member 266 is brought into firm clamping engagement with the lid 258. When the handle assemblies 262, 264 are tightly squeezed so as to move relatively toward each other, the clamping force applied to the lid 258 is caused to very significantly increase in magnitude due to the configuration of the conventional arrangement of linkage that is used to interconnect the handle assemblies 262, 264. As those who are skilled in the art readily will appreciate, the type of linkage-interconnected handle assemblies 262, 264 that are depicted in FIGS. 3–5 is of a type that has been known for many years as the so-called "vise grip linked handle clamping assembly," which assembly has been incorporated successfully (with only minor changes in component design) into more than a hundred different types of manually operated clamping tools. While the specific clamping mechanism that is depicted in FIGS. 3–5 corresponds to that used in a line of "sheet metal clamps" produced by Vise-Grip, Inc., it will be understood by those who are skilled in the art that substantially any good quality commercially available clamping assembly can be substituted for the type that is indicated generally in the drawings by the numeral 260—the principal purpose of which is to clamp the lid 258 shut when the time is at hand to drain excess moisture from towels 210 that are carried by the wringer device 250.

Referring once again to FIGS. 1 and 2, when it is desired to position the appliance 100 on a counter top or other stable horizontal support that provides adequate surface area, the hinged connection (which is provided by base-carried and lid-carried hinge set components 140 that are shown in FIG. 3) that releasably couples the lid 130 and the base 120 does not need to be released, for both the lid 130 and the base 120 can be supported in side-by-side relationship atop a countertop or other suitable support surface (not shown) that is of adequate size.

However, if it is desired to use the appliance 100 at a convenient height in a leg-supported mode beside a bed or elsewhere in one's home where a massage is to be administered, a suitable elongate base support structure that typically takes the form of a set of commercially available telescopically-length-adjustable legs 270 preferably is provided. A set of simple telescopically extensible/retractable legs that are of a type that can make a threaded connection (or other suitable form of connection, not shown) with the base 120 is designated generally by the numeral 270 in FIG. 1.

While conventional, commercially available telescopic legs 270 are shown in FIG. 1, it will be understood that neither the structure of the legs 270 nor the details of a conventional means of connection that may be selected for use in connecting the legs 270 or other support structure to the base 120 constitute features of the present invention. Naturally, however, the legs 270 should have good strength, be reliably adjustable so as to hold the length measurements to which they are set, and should be easy to extend, retract and lock in extended and retracted positions; and, the connections used therewith to releasably couple the legs 270 to the base should be selected to be reliable, sturdy and easy to use. Telescopic legs 270 that make threaded connections with the base 120 are preferred.

Referring to FIG. 2, a door-accessible elongate compartment 272 is defined by the lid 130 to receive the legs 270 or other suitable support structure during storage and transport of the appliance 100. A suitable door 274 is provided that preferably has a suitable latch (not shown) for releasably holding the door-accessible compartment 272 closed when a set of legs 270 or other suitable support structure is housed therein.

To ready the appliance 100 for storage or transport, the legs 270 or other form of base-connected support should be removed and stored in the compartment 272. The power cord 160 should be disconnected from any wall outlet or other electrical connector into which its plug 162 has been inserted, and should be inserted into the power cord storage compartment 124. The containers 156, 158 should be nested within the compartments 126, 128, as is shown in FIG. 2 (and, if any tightening of closures or disabling of the dispensing devices 157, 159 is needed to prevent leakage of liquid from the containers 156, 158, this should be attended to). If the base 120 and the lid 130 do not already have their hinge components 140 pivotally connected, the sets of hinge components 140 (see FIG. 3) should be slided back into hinge-connected pivotal relationship.

Spare dry towels 200 should be packed behind straps 275 that are carried by the lid 130, with it being permissible also to insert still other spare dry towels 200 into the main heating compartment 142 (once the pan-like device 140 and the wringer device 250 and any other components or supplies that are needed to enable the closed appliance 100 to provide a "kit" that enables a massage to be administered have been secured either within available space provided by the lid 130, or within the main heating compartment 122).

A feature of that arises from connecting the power cord 160 to the base 120 at a location inside the power cord storage chamber 124 is that the power cord 160 must be put away and not permitted to dangle outside the housing 110 of the appliance 100 if the housing 110 of the appliance is to be fully closed and latched shut, in the manner of a normal suitcase, as is preferred. By this arrangement, the power cord 160 cannot accidentally be left with its plug 162 inserted into a wall receptacle or the like so as to be feeding power to the electrical components of the base 120 at a time when the appliance 100 is believed to be closed down, turned off and otherwise readied for storage or transport.

With respect to the operation of the heating element 198 that is depicted in FIGS. 7 and 8 and described previously herein as being an electrically insulated resistance heater that is of generally U-shaped configuration, those who are skilled in the art readily will understand that a host of alternative forms of electrically powered heating units that are attached to containers are well known and may be substituted for the heating element 198 that is shown and described herein. Moreover, while no thermostat or other form of temperature control has been shown in FIG. 6 for use with the heating element 198, those who are skilled in the art will understand that a temperature control of any of a wide variety of commercially available types may be used with the heating element 198; that the thermostat or other form of temperature control that is selected for use may be a device that is pre-set, or may take the form of a consumer-adjustable control; and that such a thermostat or temperature control could be connected to and carried by either the base 120 or the container 158'. If the control is adjustable, it should be located where it is easily seen and easily accessed by a consumer, should not be of a character that will short out or cause other problems if it gets damp or is exposed to liquid, and should not be capable of operating an associated heater (such as the heating element 198) at temperatures that exceed a safe, necessary range of temperatures.

With respect to the operation of the heating elements 192, 196 that are depicted in FIGS. 7 and 8 and described previously herein as consisting of one or more electrical resistance type heaters, those who are skilled in the art will understand that it is not always possible to provide pre-set thermostat switches 190, 194 that will prove to operate the heaters 192, 196 in such a way that the heating functions they perform are always carried out at temperatures that are desired by a particular consumer. To provide the consumer with better control over the heating action of the heaters 192, 196 (or of such other forms of heaters as may be substituted for one or more of the heaters 192, 196), temperature control switches of any of a wide variety of commercially available types may comprise or be included as component parts of the temperature controls 190, 194 for operating one or both of the heaters 192, 196 at substantially the same or at appropriately different temperatures; that the thermostat(s) or other form of temperature control(s) that is/are selected for use with one or both of the heaters 192, 196 may be preset or may take the form of consumer-adjustable control(s); and that, if such thermostat(s) or temperature control(s) feature a consumer adjustable character, it/they should be located on the base 120 at easily seen and easily accessed location(s), should not be be of a character that will short out or cause other problems if exposed to dampness or to liquid, and should not be capable of operating any associated heater(s) (such as the heating elements 192, 196) at temperatures that exceed a safe, necessary range of temperatures.

An advantage that results if the thermostat or temperature control 194 takes the form of a readily accessible, consumer adjustable control is that optimum heating temperatures for both "dry" and "wet" heating of towels in the main heating compartment 122 can be provided. Furthermore, each of the thermostat or temperature control units 190, 194 (and such other thermostat or temperature control as may be used with a container-carried heater element such as the element 198) may each include an "off/on" switch and/or a timer-controlled switch that limits the period of time for which the associated heating element(s) 192, 196, 198 may be operated without being re-started. An advantage of providing timer-limited operation of the heater element(s) 192, 196, 198 is that these devices cannot then be left energized for excessive periods of time.

As will be apparent from the foregoing, the present invention provides a nicely compact, highly versatile means of transporting from place to place and storing a "kit" of apparatus and supplies that are used nicely in concert to permit a massage to be administered substantially anywhere within one's home that it is desired to use the unit. Both "wet" and "dry" heating of towels is provided for, as is the heating of body oil and/or other liquid that one may want to utilize during the administration of a massage.

While such terms as "horizontally extending," "left," "right" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A portable heating appliance having a housing that, when "closed," can be stored and transported with substantially the ease and convenience of a suitcase, and when "open" provides access to a plurality of compartments including plural heating compartments for heating substantially concurrently but in separate heating compartments a quantity of towels and a quantity of liquid such as body oil for use in concert with the administration of a massage, comprising:

a) housing means having at least two housing members including a base member and a lid member that are connected for movement relative to each other between "closed" and "open" positions, with the housing means functioning:

i) to define an array of compartments for cooperating when the housing members are "closed" 1) to receive and protectively enclose such components of the appliance as may be removed from the housing means during use of the appliance in concert with the administration of a massage, and 2) to house such supplies as are utilized in conjunction with use of appliance including a quantity of towels for being heated by the appliance, and at least one container enclosing a quantity of liquid such as body oil for being heated by the appliance; and, ii) to define, when "open," exterior structure that can be supported atop a horizontal surface for supporting at least the base member to extend substantially horizontally, and interior structure that defines within the interior of the housing means compartments that include 1) main heating compartment means for receiving and heating a plurality of towels, and 2) auxiliary heating compartment means for receiving at least one container enclosing a quantity of liquid such as body oil and for heating the quantity of liquid contained therein;

b) electrical heating means for being operated when the housing means is "open" to substantially concurrently heat 1) at least a plurality of towels that are contained within the main heating compartment means, and 2) a quantity of liquid that is contained within a container that is nested within the auxiliary heating compartment means, whereby liquid is heated so that it can be dispensed from the container substantially simultaneously with the provision of a supply of heated towels that can be withdrawn from the main heating compartment means for use in concert with the administration of a massage; and, c) wringer means configured for being contained for transport within the housing means when the housing means is "closed," and for being operated when the housing means is "open" to clamp at least one moisture-laden towel that has been heated within the main heating compartment means to extract excess moisture therefrom.

2. The portable heating appliance of claim 1 wherein the relatively movable housing members of the housing means include a base member and a lid member, and the appliance includes hinge means for selectively permitting the lid member and the base member to pivot relative to each other between "closed" and "open" positions.

3. The portable heating appliance of claim 2 wherein the hinge means includes a pair of hinges that each have one part secured to the base member, another part secured to the lid member, and disengageable connection means for selectively establishing a pivotal connection between the one and another parts to provide a releasable connection between the base member and the lid member that will permit the base member and lid member, when "open," to be disconnected from each other.

4. The portable heating appliance of claim 3 additionally including support means for being stored within the housing means when the housing means is "closed," and for being removed from the interior of the housing means when the housing means is "open," and for being connected to the exterior of the housing means for supporting the base member to extend substantially horizontally and at an elevated position above a substantially horizontal support surface.

5. The portable heating appliance of claim 4 wherein:

a) the compartment means additionally includes storage compartment means for defining an elongate storage compartment within the lid member; and, b) the elongate storage compartment is configured to receive and store the support means when the support means is not connected to the exterior of the housing means.

6. The portable heating appliance of claim 4 wherein the main heating compartment means and the auxiliary heating compartment means are defined by the base member, and wherein the electrical heating means is connected to and protectively housed within the base member 7. The portable heating appliance of claim 5 wherein the storage compartment means also defines at least one spare compartment for receiving and housing supplies that are used in concert with the administration of a massage.

8. The portable heating appliance of claim 1 wherein the main heating compartment means includes a relatively large main heating compartment that is defined by the base member, the auxiliary heating compartment means includes at least one relatively smaller auxiliary heating compartment that is defined by the base member, the main heating compartment means and the auxiliary heating compartment means both open upwardly when the base member extends substantially horizontally, and the main heating compartment has a substantially uniform depth that extends from a lower region thereof to an upper region thereof when the base member is positioned to extend substantially horizontally.

9. The portable heating appliance of claim 8 wherein the electrical heating means includes main and auxiliary electrical heaters that are associated with the main and auxiliary heating compartments, respectively.

10. The portable heating appliance of claim 9 additionally including electrical temperature control means for being electrically connected to at least a selected one of the main and auxiliary electrical heaters for controlling the electrical heating action that is provided thereby.

11. The portable heating appliance of claim 8 additionally including a pan-like support member that has a bottom wall which joins with and is perimetrically surrounded by a substantially continuous side wall, with holes being formed through the bottom and side walls to permit the passage therethrough of air, moisture, steam and the like, and with the pan-like support being shaped such that it can be introduced into the main heating compartment selectively in a "low" position wherein the bottom wall of the pan-like support member extends in the lower region of the main heating compartment, and a "high" position wherein the bottom wall of the pan-like support extends substantially along a juncture of the upper and lower regions of main heating compartment, whereby, when a quantity of water is being heated within the main heating compartment, the pan-like support member and towels supported thereby can be positioned selectively 1) in the lower region so as to be at least partially submerged in the water that is being heated for "wet" heating the towels, and 2) in the upper region so as to be supported above the water that is being heated for "dry" heating the towels as by permitting both heat energy and moisture to rise from the heated water to the location of the towels to render the towels suitable for use in concert with the administration of a massage.

12. The portable heating appliance of claim 11 wherein the main heating compartment is substantially rectangular in shape, the pan-like support is of generally rectangular shape and has a size that permits the pan-like support to be inserted into and removed from the main heating compartment selectively 1) in a "right side up" position wherein the side wall thereof extends upwardly from the bottom wall thereof, and 2) in an "upside down" position wherein the side wall thereof extends downwardly from the bottom wall thereof, with the positioning of the pan-like support in the "low" position being effected with the pan-like support being positioned "right side up" such that the bottom wall thereof extends in juxtaposition with the bottom of the main heating compartment, and with the positioning of the pan-like support in the "high" position being effected with the pan-like support being positioned "upside down" such that the bottom wall thereof is supported by the side wall of the pan-like support resting on the bottom of the main heating compartment.

13. The portable heating appliance of claim 1 wherein:

a) the compartment means includes a power cord storage compartment that is defined by the base member; and, b) the appliance additionally includes power cord means/having a length of insulated, plural conductor wire that defines a power cord for connecting the appliance with a source of electricity, with the power cord means being electrically connected near one end region of the power cord to the electrical heating means to supply electricity thereto, and with the power cord means being electrically connected near the opposite end region of the power cord to a fused electrical plug that forms a component part of the power cord means and that is configured to be selectively connected to and disconnected from a source of electrical energy to selectively provide electricity to the appliance.

14. A portable heating appliance having a housing that, when "closed," can be stored and transported with substantially the ease and convenience of a suitcase, and when "open" provides access to a plurality of compartments including plural heating compartments for heating substantially concurrently but in separate heating compartments a quantity of towels and a quantity of liquid such as body oil for use in concert with the administration of a massage, comprising:

a) housing means having at least two housing members including a base member and a lid member that are connected for movement relative to each other between "closed" and "open" positions, with the housing means functioning:

i) to define an array of compartments for cooperating when the housing members are "closed" 1) to receive and protectively enclose such components of the appliance as may be removed from the housing means during use of the appliance in concert with the administration of a massage, and 2) to house such supplies as are utilized in conjunction with use of appliance including a quantity of towels for being heated by the appliance, and at least one container enclosing a quantity of liquid such as body oil for being heated by the appliance; and, ii) to define, when "open," exterior structure that can be supported atop a horizontal surface for supporting at least the base member to extend substantially horizontally, and interior structure that defines within the interior of the housing means compartments that include 1) main heating compartment means for receiving and heating a plurality of towels, and 2) auxiliary heating compartment means for receiving at least one container enclosing a quantity of liquid such as body oil and for heating the quantity of liquid contained therein;

b) electrical heating means for being operated when the housing means is "open" to substantially concurrently heat 1) at least a plurality of towels that are contained within the main heating compartment means, and 2) a quantity of liquid that is contained within a container that is nested within the auxiliary heating compartment means, whereby liquid is heated so that it can be dispensed from the container substantially simultaneously with the provision of a supply of heated towels that can be withdrawn from the main heating compartment means for use in concert with the administration of a massage; and, c) wringer-like means having a panlike base, a lid hingedly connected to the pan-like base, and clamping means connected to the pan-like base and being operable to clampingly engage the lid to move the lid relatively toward the pan-like base for clamping a plurality of towels therebetween for extracting excess moisture therefrom.

15. The portable heating appliance of claim 14 wherein the pan-like base has a bottom wall and a side wall that extends perimetrically about the bottom wall, and holes are formed through at least a selected one of the bottom wall and the side wall to permit moisture to pass therethrough.

16. The portable heating appliance of claim 14 wherein the clamping means includes handle means having a pair of relatively movable handles, with one of the relatively movable handles being connected rigidly to the pan-like base, and with the other of the relatively movable handles being movably connected to said one of the handles and to a clamping member that is movable in a direction toward clamping engagement with the lid in response to the two relatively movable handles being squeezed relatively toward each other, whereby towels positioned between the lid and the pan-like base are compressed to extract excess moisture.

17. The portable heating appliance of claim 14 wherein the apparatus additionally includes container means for enclosing a quantity of liquid such as body oil, and wherein the heating means includes 1) heating element means that is carried by the container means for heating a quantity of liquid that is contained by the container means, and 2) electrical connection means for establishing an electrical connection between electrical connectors that are carried by the base member and by the heating element means so that electricity can be supplied to the heating element means when the container means is positioned within the auxiliary heating compartment means.

18. The portable appliance of claim 17 wherein said container includes a manually operated dispenser for dispensing heated fluid contents therefrom.

19. The portable appliance of claim 17 wherein the appliance additionally includes housing support means for being releasably connected to said housing means for engaging a floor surface for supporting at least a selected portion of the housing means at an elevated height above the floor surface when the housing means is "open," and for being carried within housing means when the housing means is "closed."

20. A portable heating appliance for warming towels and liquid such as body oil for use in concert with the administration of a massage, comprising:

a) housing means formed from a plurality of relatively movable housing components 1) for being oriented in a "closed" position wherein the housing components are connected and cooperate to define and extend peripherally about a plurality of interior compartments to protectively enshroud the interior compartments and any contents contained therein so as to provide a kit-like unit that can be transported and stored with substantially the same ease as a suitcase when the housing components are "closed," and 2) for being relatively movable between the "closed" position and an "open" position wherein the housing components cooperate to permit access to the interior compartments;

b) support means configured to be insertable into and removable from the interior compartment when the housing components are "open" for selectively being stored within one or more of the interior compartments when the housing components are "closed," and for selectively, being interposed between a selected one of the housing components and a surface that underlies the selected housing component for being releasably connected to the selected housing component and for supporting the selected housing component at a desired height above the underlying surface to facilitate the use of the appliance in concert with the administration of a massage;

c) chamber defining means connected to the selected housing component for defining a relatively large main heating chamber as one of said plurality of interior compartments, which main heating chamber can be utilized when the housing components are "open" to receive a plurality of towels that are to be heated within the main chamber for use in concert with the administration of a massage, for defining at least one auxiliary chamber as another of said plurality of interior compartments, which auxiliary chamber can be utilized when the housing components are "open" to receive at least one container of liquid such as body oil that is to be heated within said auxiliary chamber for use in concert with the administration of a massage, and for permitting the housing components to be "closed" at a time 1) when a plurality of towels are received within the main chamber, 2) when at least one container of liquid is received within said at least one auxiliary chamber, and 3) when said support means is positioned within at least one of the interior compartments, whereby the configuring of the appliance for storage within a minimum of space is facilitated, and the overall size of the appliance is minimized for transport;

d) electrical heating means connected to and carried within the selected housing component for heating towels that are positioned within the main chamber to a first predetermined temperature that renders the towels suitable for use in concert with the administration of a massage, and for heating at least one container of liquid that is received within said at least one auxiliary chamber to a second predetermined temperature that renders the liquid suitable for use in concert with the administration of a massage; and, e) wringer means configured for being contained for transport within the housing means when the relatively movable housing components are "closed," and for being operated when the relatively movable housing components are "open" to clamp at least one moisture-laden towel that has been heated within the main heating chamber to extract excess moisture from the clamped towel.

21. The portable heating appliance of claim 20 wherein the relatively movable housing members of the housing means include a base member and a lid member, and the appliance includes hinge means for selectively permitting the lid member and the base member to pivot relative to each other between "closed" and "open" positions.

22. The portable heating appliance of claim 21 wherein the hinge means includes a pair of hinges that each have one part secured to the base member, another part secured to the lid member, and disengageable connection means for selectively establishing a pivotal connection between the one and another parts to provide a releasable connection between the base member and the lid member that will permit the base member and lid member, when "open," to be disconnected from each other.

23. The portable heating appliance of claim 21 wherein the main heating chamber and the auxiliary heating chamber are defined by the base member, and wherein the electrical heating means is connected to and protectively housed within the base member.

24. The portable heating appliance of claim 23 wherein the chamber defining also defines at least one spare compartment for receiving and housing supplies that are used in concert with the administration of a massage.

25. The portable heating appliance of claim 20 wherein the electrical heating means includes main and auxiliary electrical heaters that are associated with the main and auxiliary heating chambers, respectively.

26. The portable heating appliance of claim 25 additionally including electrical temperature control means for being electrically connected to at least a selected one of the main and auxiliary electrical heaters for controlling the electrical heating action that is provided thereby.

27. The portable heating appliance of claim 20 additionally including a pan-like support member that has a bottom wall which joins with and is perimetrically surrounded by a substantially continuous side wall, with holes being formed through the bottom and side walls to permit the passage therethrough of air, moisture, steam and the like, and with the pan-like support being shaped such that it can be introduced into the main heating chamber selectively in a "low" position wherein the bottom wall of the pan-like support member extends in the lower region of the main heating chamber, and a "high" position wherein the bottom wall of the pan-like support extends substantially along a juncture of the upper and lower regions of main heating chamber, whereby, when a quantity of water is being heated within the main heating chamber, the pan-like support member and towels supported thereby can be positioned selectively 1) in the lower region so as to be at least partially submerged in the water that is being heated for "wet" heating the towels, and 2) in the upper region so as to be supported above the water that is being heated for "dry" heating the towels as by permitting both heat energy and moisture to rise from the heated water to the location of the towels to render the towels suitable for use in concert with the administration of a massage.

28. The portable heating appliance of claim 27 wherein the main heating chamber is substantially rectangular in shape, the pan-like support is of generally rectangular shape and has a size that permits the pan-like support to be inserted into and removed from the main heating chamber selectively 1) in a "right side up" position wherein the side wall thereof extends upwardly from the bottom wall thereof, and 2) in an "upside down" position wherein the side wall thereof extends downwardly from the bottom wall thereof, with the positioning of the pan-like support in the "low" position being effected with the pan-like support being positioned "right side up" such that the bottom wall thereof extends in juxtaposition with the bottom of the main heating chamber, and with the positioning of the pan-like support in the "high" position being effected with the pan-like support being positioned "upside down" such that the bottom wall thereof is supported by the side wall of the pan-like support resting on the bottom of the main heating chamber.

29. The portable heating appliance of claim 20 wherein:

a) the chamber defining means includes a power cord storage compartment that is defined by the base member; and, b) the appliance additionally includes power cord means having a length of insulated, plural conductor wire that defines a power cord for connecting the appliance with a source of electricity, with the power cord means being electrically connected near one end region of the power cord to the electrical heating means to supply electricity thereto, and with the power cord means being electrically connected near the opposite end region of the power cord to a fused electrical plug that forms a component part of the power cord means and that is configured to be selectively connected to and disconnected from a source of electrical energy to selectively provide electricity to the appliance.

30. A portable heating appliance for warming towels and liquid such as body oil for use in concert with the administration of a massage, comprising:

a) housing means formed from a plurality of relatively movable housing components 1) for being oriented in a "closed" position wherein the housing components are connected and cooperate to define and extend peripherally about a plurality of interior compartments to protectively enshroud the interior compartments and any contents contained therein so as to provide a kit-like unit that can be transported and stored with substantially the same ease as a suitcase when the housing components are "closed," and 2) for being relatively movable between the "closed" position and an "open" position wherein the housing components cooperate to permit access to the interior compartments;

b) support means configured to be insertable into and removable from the interior compartment when the housing components are "open" for selectively being stored within one or more of the interior compartments when the housing components are "closed," and, for selectively being interposed between a selected one of the housing components and a surface that underlies the selected housing component for being releasably connected to the selected housing component and for supporting the selected housing component at a desired height above the underlying surface to facilitate the use of the appliance in concert with the administration of a massage;

c) chamber defining means connected to the selected housing component for defining a relatively large main heating chamber as one of said plurality of interior compartments, which main heating chamber can be utilized when the housing components are "open" to receive a plurality of towels that are to be heated within the main chamber for use in concert with the administration of a massage, for defining at least one auxiliary chamber as another of said plurality of interior compartments, which auxiliary chamber can be utilized when the housing components are "open" to receive at least one container of liquid such as body oil that is to be heated within said auxiliary chamber for use in concert with the administration of a massage, and for permitting the housing components to be "closed" at a time 1) when a plurality of towels are received within the main chamber, 2) when at least one container of liquid is received within said at least one auxiliary chamber, and 3) when said support means is positioned within at least one of the interior compartments, whereby the configuring of the appliance for storage within a minimum of space is facilitated, and the overall size of the appliance is minimized for transport;

d) electrical heating means connected to and carried within the selected housing component for heating towels that are positioned within the main chamber to a first predetermined temperature that renders the towels suitable for use in concert with the administration of a massage, and for heating at least one container of liquid that is received within said at least one auxiliary chamber to a second predetermined temperature that renders the liquid suitable for use in concert with the administration of a massage; and, e) wringer-like means that is insertable into the main heating chamber to support towels to be heated therein, wherein the wringer-like means has a pan-like base, a lid hingedly connected to the pan-like base, and clamping means connected to the pan-like base and being operable to clampingly engage the lid to move the lid relatively toward the pan-like base for clamping a plurality of towels therebetween for extracting excess moisture therefrom.

31. The portable heating appliance of claim 30 wherein the pan-like base has a bottom wall and a side wall that extends perimetrically about the bottom wall, and holes are formed through at least a selected one of the bottom wall and the side wall to permit moisture to pass therethrough.

32. The portable heating appliance of claim 30 wherein the clamping means includes handle means having a pair of relatively movable handles, with one of the relatively movable handles being connected rigidly to the pan-like base, and with the other of the relatively movable handles being movably connected to said one of the handles and to a clamping member that is movable in a direction toward clamping engagement with the lid in response to the two relatively movable handles being squeezed relatively toward each other, whereby towels positioned between the lid and the pan-like base are compressed to extract excess moisture.

33. The portable heating appliance of claim 30 wherein the apparatus additionally includes container means for enclosing a quantity of liquid such as body oil, and wherein the heating means includes 1) heating element means that is carried by the container means for heating a quantity of liquid that is contained by the container means, and 2) electrical connection means for establishing an electrical connection between electrical connectors that are carried by the base member and by the heating element means so that electricity can be supplied to the heating element means when the container means is positioned within the auxiliary heating compartment means.

34. The portable appliance of claim 30 wherein said container includes a manually operated dispenser for dispensing heated fluid contents therefrom.

35. The portable heating appliance of claim 1 wherein the wringer means includes clamping means having at least two members that are movable relatively away from each other to permit a moisture-laden towel to be inserted therebetween, and that are movable relatively toward each other to clamp at least one moisture-laden towel that has been heated within the main heating compartment means to extract excess moisture therefrom.

36. The portable heating appliance of claim 35 wherein the clamping means is configured to be supported by the housing means during the clamping of a moisture-laden towel at a position relative to the main heating compartment means that will cause moisture extracted from a clamped towel to drain into the main heating compartment means.

37. The portable heating appliance of claim 20 wherein the wringer means includes clamping means having at least two members that are movable relatively away from each other to permit a moisture-laden towel to be inserted therebetween, and that are movable relatively toward each other to clamp at least one moisture-laden towel that has been heated within the main heating chamber to extract excess moisture therefrom.

38. The portable heating appliance of claim 37 wherein the clamping means is configured to be supported by the housing means during the clamping of a moisture-laden towel at a position relative to the main heating chamber that will cause moisture extracted from a clamped towel to drain into the main heating chamber.

* * * * *